US005323725A

United States Patent [19]

Conrad et al.

[11] Patent Number: 5,323,725

[45] Date of Patent: Jun. 28, 1994

[54] SPINNAKER

[75] Inventors: Peter G. Conrad, Greensboro; Edward S. Germond, III, Athens, both of Ga.

[73] Assignee: Sobstad Corporation, Greensboro, Ga.

[21] Appl. No.: 96,617

[22] Filed: Jul. 23, 1993

[51] Int. Cl.[5] ..... B63H 9/06

[52] U.S. Cl. ..... 114/103

[58] Field of Search ..... 114/39.1, 39.2, 102, 114/103, 109, 113, 114, 115; 428/105, 98, 253, 293, 294

[56] References Cited

U.S. PATENT DOCUMENTS

| | | | |
|---|---|---|---|
| 3,680,519 | 8/1972 | Jalbert | 114/103 |
| 3,974,791 | 8/1976 | Haarstick et al. | 114/103 |
| 4,593,639 | 6/1986 | Conrad | 114/103 |
| 4,708,080 | 11/1987 | Conrad | 114/103 |
| 4,953,489 | 9/1990 | Bassett | 114/103 |
| 5,038,700 | 8/1991 | Conrad | 114/103 |

*Primary Examiner*—Stephen P. Avila
*Attorney, Agent, or Firm*—Fred A. Keire

[57] ABSTRACT

A spinnaker wherein the head section of the spinnaker incorporates a novel panel and sub-panel layout which improves the control of the spinnaker in use and allows projection of a greater sail area.

30 Claims, 7 Drawing Sheets

PANEL #7

PANEL #6

SPINNAKER

This invention relates to sails, more particularly this invention relates to a spinnaker sail, its novel configuration and method of making. Still more particularly this invention relates to a spinnaker sail panel configuration, the materials used in the sail and its construction.

BACKGROUND FOR THE INVENTION AND DISCUSSION OF PRIOR ART

A spinnaker sail has evolved through a number of developments. These developments have in part been associated with the developments in spinnaker sail material and in part from a better understanding how this sail has to function under optimum performance conditions. Although some spinnaker sails have been designed specifically for running conditions, i.e. for apparent wind angles of about 110° to 180° aft of the beam and others for reaching conditions of about 60° to 100°, an all-purpose spinnaker sail is the preferred sail of choice and is typically required to perform well in reaching and running conditions.

A well designed, all purpose spinnaker will thus be a compromise between a running spinnaker and a reaching spinnaker and eliminates the need for excessive number of spinnakers for light, medium and heavy conditions for which spinnakers have typically been designed based on nylon cloth weights of 0.5, 0.75 and 1.5 oz. per sailmaker's yard, respectively, for an average sized boat of about 37 feet in length. These weights are only nominal. Actual finished weights are always higher by the following percentage 0.5 oz.–100%; 0.75 oz.–66%; 1.5 oz.–50%. Moreover, this compromise in purpose carries over in the materials used. A running spinnaker does not have as heavy a load imposed on it as a reaching spinnaker under the same normal sailing conditions. However, a shock load imposed on a spinnaker when it collapses and refills is considerable be it experienced by a reaching or a running spinnaker.

Early spinnaker designs utilized very light woven cotton materials. However, the weight of these materials was still considerable and the spinnakers could not support broad shoulders. Other materials were tried such as silk, but until the appearance of woven nylon, the materials were not satisfactory to provide the all purpose characteristics a woven nylon fabric was able to provide.

Nylon has a combination of characteristics which renders it very suitable for making spinnakers. Nylon is a polyamide of various chemical compositions of which Nylon 6 or Nylon 66 is a typical material. Nylon has high tensile strength for a given denier and also high elasticity. Consequently, nylon has the ability to carry the high loads imposed under normal load carrying conditions and also readily meets the high shock loads which are in part absorbed by the elastic properties of nylon.

When designing a shape into this sail, an evolution of design features has also occurred. Early spinnaker designs were cross-cut such that not much of a shoulder was possible to design into the spinnaker and the smooth curves for optimum performance especially in the head of a sail could not be achieved by this design in such sail. Such sails were said to carry a "nose" in the head portion of the spinnaker. A shoulder is defined as the area of sail projecting outside of an imaginary line drawn from a midpoint of a spinnaker leach or luff to the head of the spinnaker. The leach on the shoulder forms an arc for which the imaginary line as mentioned above is a chord. A head section of the spinnaker has its bottom at the vertical point on each leach at which the leaches cease to be parallel and begin to converge area where the leach and the luff start converging.

Large shoulder, imply a large head angle. A head angle is defined as the angle formed by the leaches at the head of spinnaker sail. Early spinnaker designs based on a cross-cut design or on modified cross-cut design were not able to support a large head angle, because loads in the head section were not properly dealt with in these spinnakers. Modified cross-cut spinnakers' head panels were placed perpendicular to the leach or luff and met in a chevron fashion in a middle seam of spinnaker. Such spinnaker's were said to show an "elephant's behind". However, the modified cross-cut spinnakers were desirable because construction of these was relatively simple and the panels could be oriented perpendicular to the leaches of the sail. Such orientation was necessary to place some loads on a "thread line" and not on a bias of the woven material. For purposes of present discussion and because most spinnakers are symmetrical "leach" and "luff" is interchangeable in meaning. For asymmetrical spinnakers, leach and luff has a set meaning.

Early nylon spinnakers were made of the cross-cut or modified cross-cut type; with the understanding of load or stress maps in a spinnaker, advances were made in spinnaker designs. Typically, to accommodate the point loads in the head, tack and clew of a sail, the threads in the material should align with the lines of stress into (or out of) the point loads. Conversely, to accommodate the aerodynamic loads in the spinnaker the threads should align with the aerodynamic loads imposed on the spinnaker cloth. This understanding of stress maps first resulted in the design of radial head spinnakers which had their origin as made by Sutter Sailmakers in California and was then improved by Wally Ross of Hard Sails.

Sutter spinnakers carried the radial panel from the head all the way into the foot of the sail. Wally Ross spinnakers carried the radial gores of the material for the head into the shoulders but stopped at the center panels or center section where the aerodynamic loads were negligible and fabrication methods favored the old cross-cut panel alignment. By a cross-cut panel it is meant a panel which is carried from the luff to leach or about perpendicular from luff to leach to midline fold or center seam of a spinnaker. As mentioned above typically the panels are perpendicular to the leach and to the centerfold when the sail is folded in half vertically.

Thereafter, the radial head spinnaker evolved into a "tri-radial" spinnaker which had the radial head panels for the head, and to accommodate the point loads in the tack and clew had radiating panels from these two point load radiating to a center seam. The clew and tack radiating panels reached up to the center panels which were the old type cross-cut panels. The number of center panels could vary. "Offset tri-radial" spinnakers were developed to carry the catenaries better from the bottom tri-radial panels into the center panels by making the center panels into a number of rhomboidal shapes.

Concurrently, with the radial head spinnakers star-cut spinnakers were developed which were well suited for reaching but did not have the all purpose characteristics of the tri-radial spinnaker. Star-cut spinnakers did not have any cross-cut panels in the center section of the sail and the radiating panels from the head, tack and clew joined in the approximate center of a sail to form a "tri-star". However, star-cut spinnakers could not be made sufficiently full to be a satisfactory all purpose spinnakers.

Although many attempts have been made to supplant nylon materials by various other materials such as by very light weight polyester fabrics, plastic film, laminated plastic film and the like, the present light weight nylon materials are still preeminent.

Nevertheless, the first departure from typical fabric materials has been made by designing the material for the characteristics it has to possess in the particular locations in the spinnaker. Such development had its genesis in Conrad U.S. Pat. No. 4,593,639, and Conrad U.S. Pat. No. 4,708,080 which resulted in Conrad U.S. Pat. No. 5,038,700 and show the extensive art by the citation of the prior art found in these patents. The last patent addressed some of the prior art problems in spinnakers. The present invention is a further improvement based on my last patent and in addition incorporates novel combinations of materials and design features in the spinnaker.

BRIEF DESCRIPTION OF THE INVENTION

Thus, the present invention is a development of the Conrad U.S. Pat. No. 5,038,700, but employs an entirely new method for shaping cross-cut panels in order to introduce smooth curves in the head of the spinnaker (i.e. eliminate the "nose", minimize and/or eliminate center crease, etc.), to support the shoulders of the spinnakers demanded by the present, novel materials employed herein, and to take advantages of the best features of the cross-cut spinnaker concept because of the simplicity of its construction and the tri-radial or offset tri-radial spinnakers because of their all-purpose characteristics, and to circumvent some problem endemic to the triradial spinnaker inability to demonstrate precise leach tension control and necessity for increasing camber as width is increased in sail.

Thus, the present invention is a departure from a modified tri-radial and a cross-cut spinnaker and incorporates non-obvious by the advantages and the best features of either spinnaker and provides an entirely new panel design layout to take advantage of the material to accommodate the stresses in the sail material, especially in combination with thread layouts as shown in U.S. Pat. No. 5,038,700. The present design features of the spinnaker make the spinnaker eminently suitable as a reaching and a running spinnaker and make this spinnaker an extremely versatile all around, all purpose spinnaker performing as an excellent running and reaching spinnaker when so flown.

Moreover, because of the design features, the spinnaker can now utilize materials other than nylon (although nylon is just as suitable). Thus spun-bonded, non-woven polyalkylene polymer sheets such as polyethylene, polypropylene, modified copolymers of these, with or without films of the same materials on one or both sides of the sheet are now employable. Typical materials of this type are available under the trademarks TYPAR, TEKTON and REEMAY (trademarks of Reemay, Inc.) and may be obtained from Reemay, Inc., Old Hickory, Tenn. Other like material as TYVEK is obtainable from DuPont & Co. of Wilmington, Del. Of the above materials TYPAR TM is the preferred material. The detailed description and properties for these spun bonded products are available from Reemay, Inc. such as the "Reemay ® Spunbonded Polyester" Bulletin or "Typar ® Spunbonded Polypropylene" Bulletin. Of the available materials the preferred spunbonded materials are the straight non-crimped e.g. 2.2 denier or less filament material. The lightest available material is preferred including such as lightest propylene film, or nylon capped Typar or Tyvek or like material. Of course for the lightest weight spinnaker sails the lightest weight material is selected. One sided or two sided film lamination is suggested depending on the weight and strength desired including the selection of appropriate fibers of suitable denier and fiber thread density per given linear measure in a panel.

The properties for the spun bonded materials may be determined in accordance with TAPPI or ASTM standards. Although spun bonded materials may be used preferentially, other non-woven, light weight materials of various other bonding types and/or schedules may be employed.

Other candidate materials that suggest themselves for application are non-woven spun-bonded nylon, spun bonded polyvinylidene halides such as polyvinylidene fluoride or the film of which in combination with the foregoing is also employable with great advantage and is sold under the trademark TEDLAR TM (available from DuPont & Co. of Wilmington, Del.).

These spun-bonded, non-woven materials, either film backed on non-backed, are suitable because of their costs, load carrying capacity, response to lamination and the ability to utilize these in combination with the novel design features for spinnakers that have very desirable shape retention characteristics achievable with proper stress distributing elements for all-around, all-purpose stress bearing. In addition typical nylon material as used today may also be employed if laminated to a film from 0.2 mils to 1 mil thick. Such films are those previously mentioned. The preferred films are polyester films such as MYLAR ® and further polyvinylidene fluoride films such as TEDLAR ® and polyurethane films. Symmetrical as well as asymmetrical spinnakers are within the purview of the invention.

DETAILED DESCRIPTION OF THE INVENTION THE DRAWINGS AND THE SEMIBODIMENTS OF THE INVENTION

With reference to the drawings herein and the invention as depicted by the embodiments illustrated in the drawings, wherein.

Figure 8:
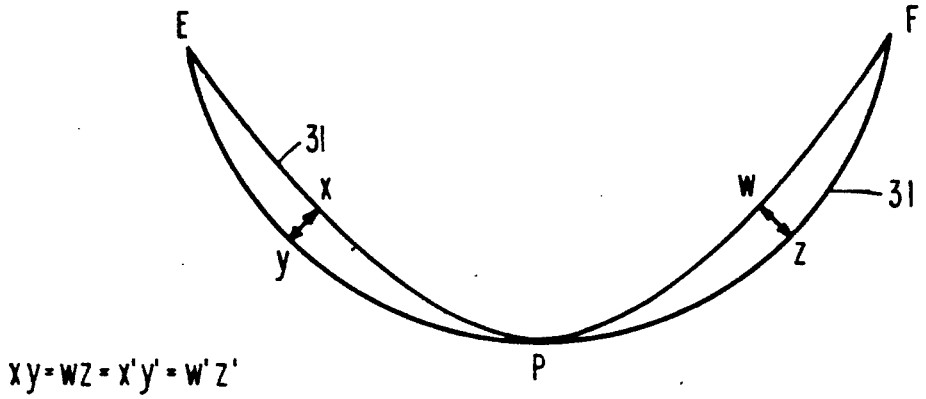
FIG. 8 illustrates in a front schematic view the insert panels to be placed in the panel shown in FIG. 7.
Figure 9:
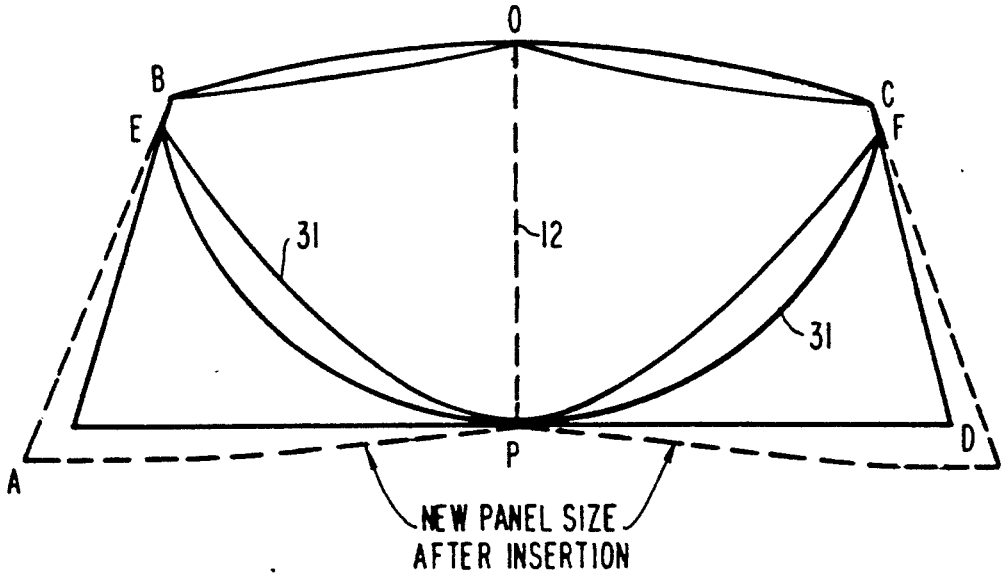
FIG. 9 illustrates in a front view a panel resulting from the combination of the panels of FIG. 7 and FIG. 8.
Figure 9A:
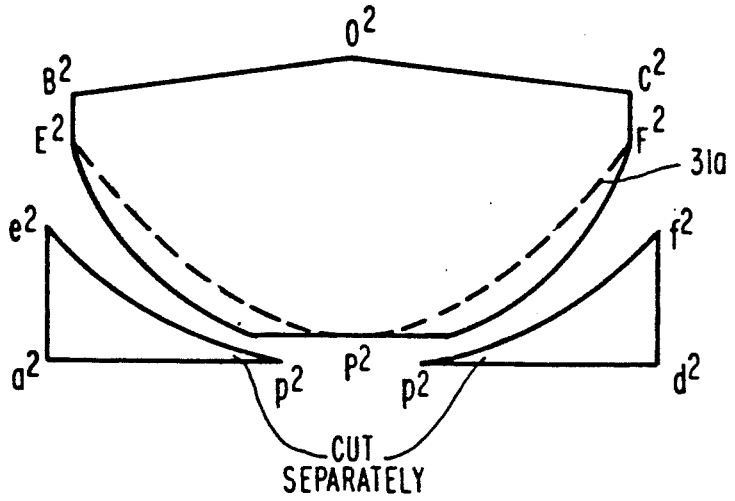
Figure 9B:
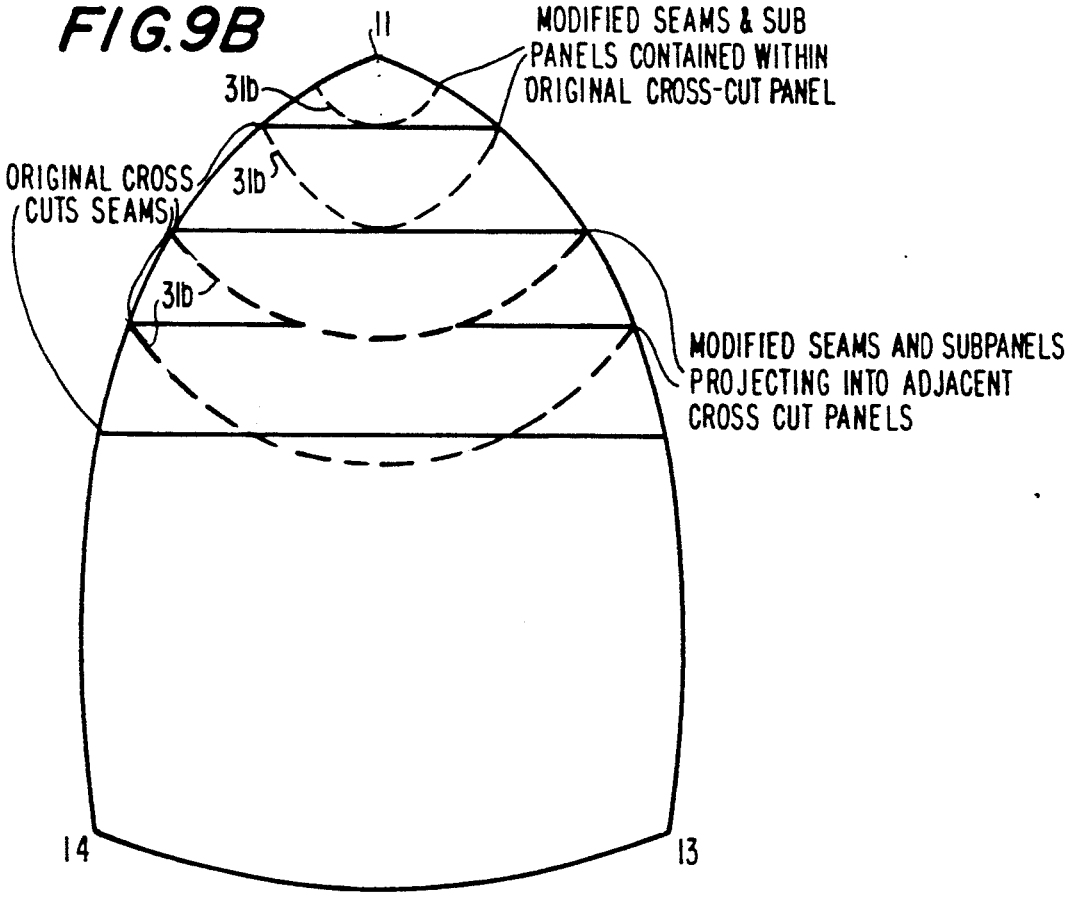
Figure 10:
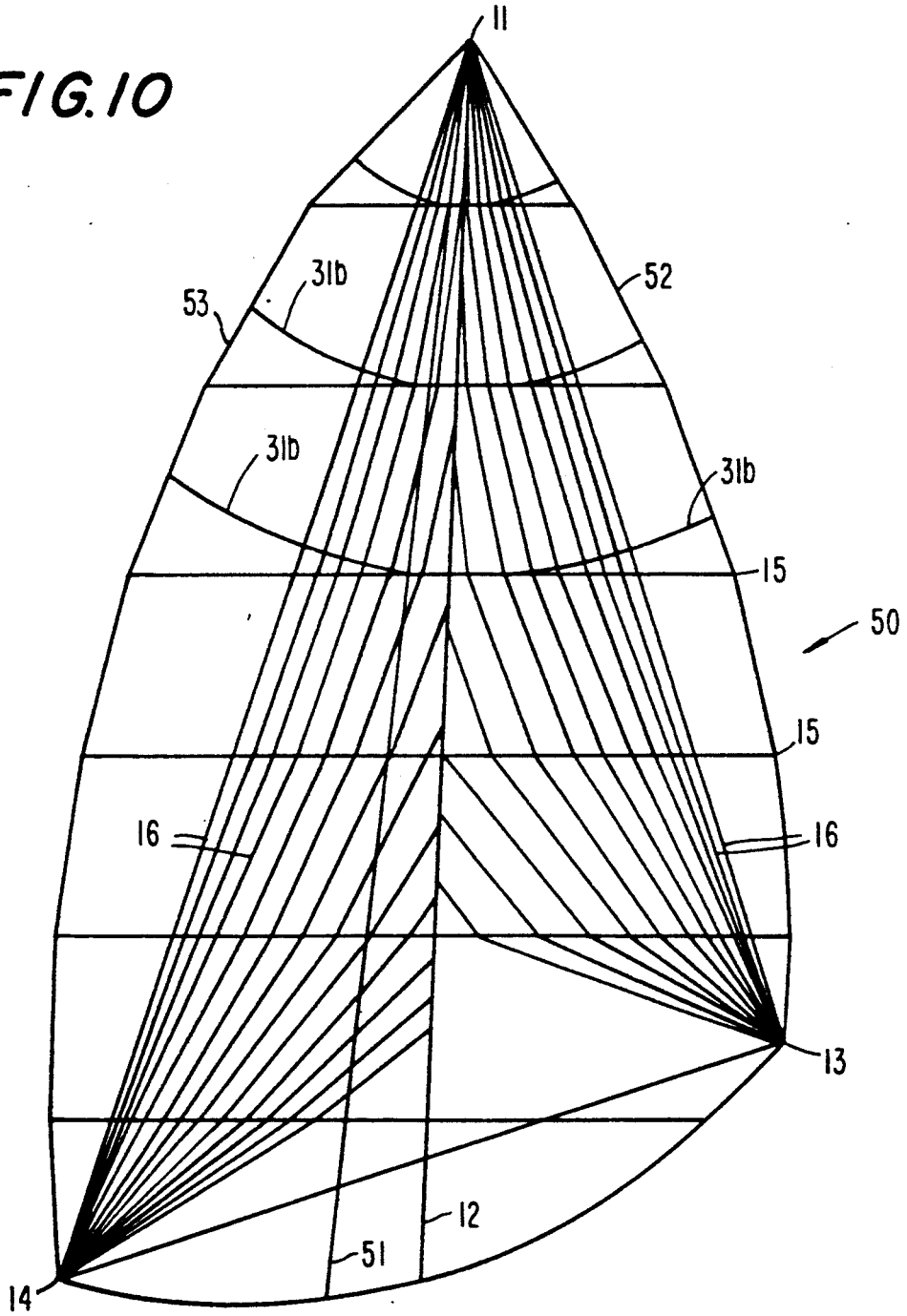

FIG. 9*a* illustrates in a front view another embodiment of the novel spinnaker panel layout;

FIG. 9*b* illustrates a front view of a spinnaker showing schematically a further embodiment showing seam shaping over more than one panel; and FIG. 10 is a perspective front view of an asymmetrical spinnaker illustrating schematically the panels which are to be modified in accordance with the novel panels as shown in FIGS. 8 and 9.

Figure 1:
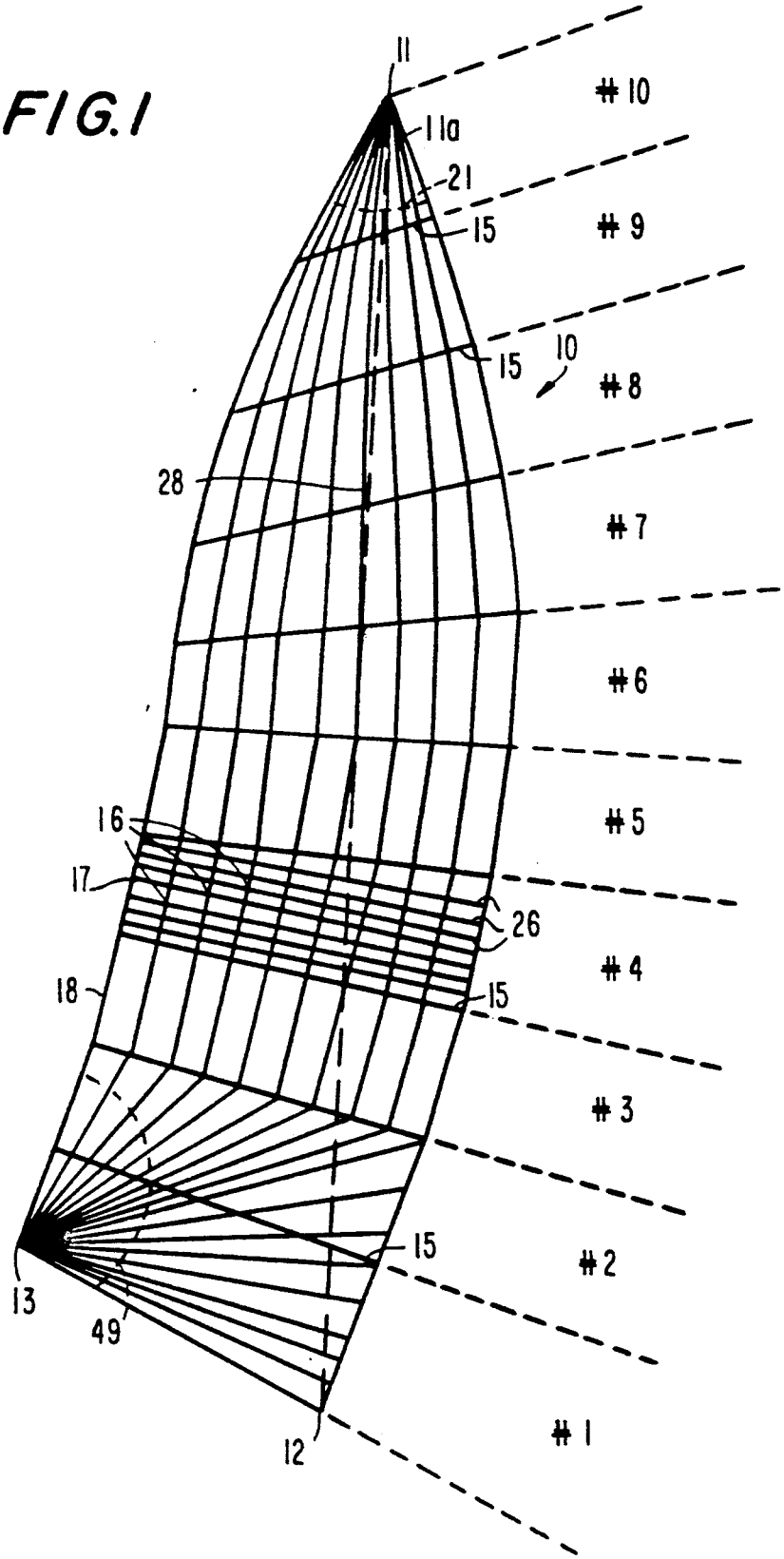
FIG. 1, is a side-view of a typical symmetrical half folded spinnaker to show the panel layout thereof.

Turning now specifically to the drawings, in FIG. 1 the spinnaker sail 10 has a head 11, clew 13 and tack 14. The bottom corner representing tack 14 is not shown, as the spinnaker is folded in half and is symmetrical about the centerline. However, the other side of the sail is a mirror image of the side shown, and thus can best be re presented for its accurate shape by being folded about midline 12. In FIG. 1, the midline 12 is the right most line of the spinnaker sail. The foot of the sail has been identified as 12*a*.

The sail consists of ten panels, specifically identified except that the head panel 11*a* may be of sandwich construction to carry the higher loads into the head. Each of the panels is joined to the next panel by a seam 15. The spinnaker sail 10 may be made of nylon woven material, non-woven material, such as the spun bonded polyalkylene material with or without film reinforcement and a film or non-woven material which is fiber reinforced as disclosed in my U.S. Pat. Nos. 4,708,080 and 5,038,700 and which are incorporated by reference herein.

Although not all of the threads connecting the head 11 to the clew 13 have been shown, these are evident from the catenary location of these threads on the spinnaker. These threads are shown figuratively as 16 and follow the precepts as shown in U.S. Pat. No. 4,708,080 for each of the panels, as well as the density thereof. Crossover point 17 has been shown on the leech 18 of the spinnaker 10. Crossover point 17 is defined as the point when a straight edge is placed on the drawing on points 13 and 11, and the location where the line intersects the leech 18 at point 17. This point is defined as "cross-over point".

Inasmuch as in a side view the catenaries change the direction at that point, namely—the "S" curve defined by leech 18 changes from a concave to a convex shape, the catenaries below crossover point 17 are concave and above crossover point 17 are convex in side view.

Because of the freedom in the construction provided by U.S. Pat. No. 4,708,080, the improved spinnaker at the crossover point 17 and one of the panels above and below thereof may carry extra threads in such panels in the luff 23 area and leech 18 are, i.e., about 1/5 to ¼ width of the panel from each edge of the sail. Thus, the failure mode is not dependent on the woven cloth technology and the bias problems presently inherent in all spinnaker construction and may be circumvented by the added capability of transmitting the load and the stress in the sail without failure thereof.

The above described developments associated with the radial and tri-radial spinnaker art have contributed to a wasteful use of materials. The wasted use of the material in such a spinnaker is fairly enormous. The steps used for making e.g. the tri-radial spinnakers have added complexity to the point where cutting and sewing of the material is extremely labor and material intensive.

FIG. 1, however, represents a spinnaker that has returned to the original panel shape of the spinnakers improved, however, with the new design in the head portion thereof e.g., for panels #7 to #10, without any of the disadvantages of the spinnaker cloth waste dictated by the shaping of panels, such as illustrated by developments identified as cross-cut, radial head, tri-radial and offset tri-radial spinnakers. This advantage has been realized because of the seam-fiber orientation independence previously mentioned and the ability to produce smooth curves superior to the radial head spinnaker because of the flatness in the head panels e.g., 9 and 10.

For a maxiboat spinnaker, that is, a boat of about 80 feet long, the useful sail area for a spinnaker is about 650 square yards, whereas the material that is needed to cut and shape the panels is about 850 to 1000 square yards, depending on construction. Hence, the savings for each of the panels made in accordance with the present invention are sizable of the order of about 30% and higher for the average size boat, without the disadvantages of the use of an enormous number of material gores and seams to achieve the proper shaping of the sails. Moreover, polymer films, as further disclosed herein, may be used for the sail film membrane and the threads 16 and 26 may be confined therebetween; the threads act as proper structure for the sail.

Figure 2:
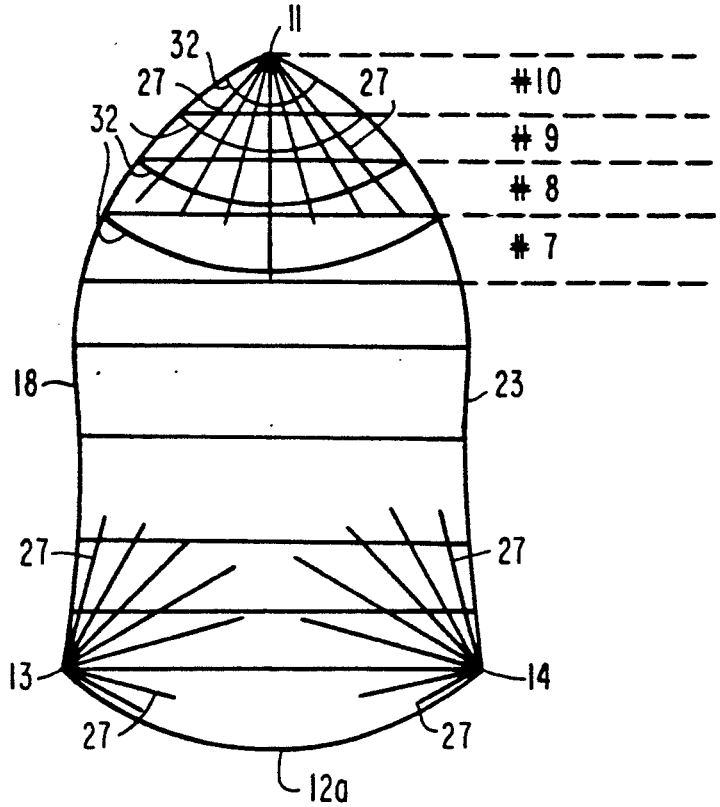
FIG. 2 is a front view of an open spinnaker showing schematically the present invention.

For small sails where the above-described non-woven material e.g., available from Reemay Inc., may be used in center panels #3 to #6, the corners are reinforced by structural members 27 as shown in FIG. 2. Such added reinforcement may be sufficient. These corner reinforcements may be in a form of threads, flat ribbon like materials e.g., flattened threads for a denier weight of 400 to 7500, tapes of monofilament material glued together or woven into ribbon form, woven and non-woven tapes and the like. These fibers, threads, monofilaments may be of nylon, polyester, polyaramids such as KEVLAR® or TAVRON® and others such as VECTRAN® (a trademark of Hoechst Celanese). Consequently, depending on the size of the sail, these structural members 27 of suitable materials radiate out into the spinnaker of a suitable appropriate number, thread or tape size or weight and distance to support the corner loads at head 11, clew 13 and tack 14 for each spinnaker and designed either for light, medium or heavy spinnaker sail use.

As film material for the sail membrane, one may use polyester film sold as MYLAR® by DuPont & Co., polyvinylidene fluoride, e.g., TEDLAR®, a DuPont & Co. trademarked product; fluoroplastics, such as ethylene chlorotrifluoro ethylene copolymer; ethylene tetrafluoro ethylene copolymer; fluorinated ethylene propylene copolymer; perfluoro alkoxy polymers; polychloro trifluoro ethylene copolymer; polyurethane; polyvinylidene fluoride copolymer; Nylon 11 and 12; other thermoplastic polyester polyalkyls; biaxiially oriented polypropylene, films of polymer and copolymer alloys polyquinone polymer films and the like, etc. An ideal yardstick for useful films and to determine the film properties most suitable for a said film is to use the TEDLAR® or MYLAR film as a standard. If the properties of the film are equivalent to either for equivalent thickness or if better, then the material is highly desirable. Moreover, these films may be laminated in different combinations to each other, or even to other films.

Typically the films on either side of the threads 16 and 26 may range from ¼ mil (inches) up to 2 and 3 mil thickness depending on the location used. For light weather sails, lighter films are used, e.g., 1/5 mil, ¼ mil and ½ mil films are suitable, however, thinner films are available today.

MYLAR ®, although used heretofore extensively in the sailcloth making art,, is somewhat brittle and not sufficiently puncture resistant or tear propagation resistant. TEDLAR ® has superior properties for each of the desirable criteria, e.g. flex life, tear propagation, puncture resistance, resistance to water absorption, good ultraviolet resistance, tear strength, etc. These properties are determined in accordance with the test procedures identified in *Modern Plastics Encyclopedia,* McGraw-Hill, New York, N.Y. 1989.

In reference to FIG. 2, the upper four panels identified as #7 to #10 carry, however, a novel construction as will be further explained herein.

Figure 4:
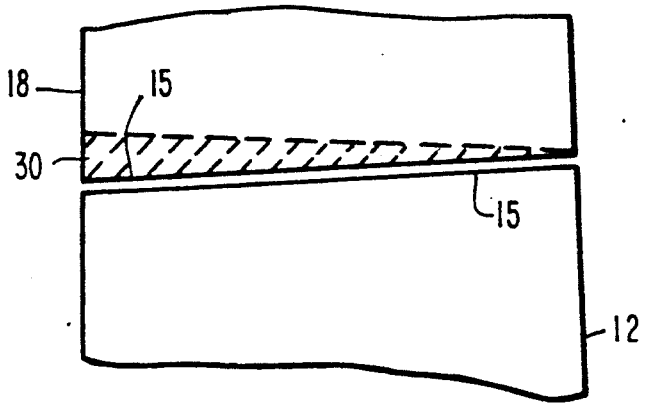
FIG. 4 illustrates in a partial side view a cross-cut panel of a spinnaker with a wedge cut out to make the center fold seam longer than the length of a leach and luff.

At this time it should be appropriate to explain the reasons for such construction. The cross-cut panel shaping mechanism is shown in FIG. 4, allows one to add depth or fullness, i.e. the maximum distance between the right hand midline 12 and the imaginary straight line 28 between head 11 and clew 13. The resultant design is one where the upper e.g., last two panels #9 and #10 are both wider and flatter (greater shoulders and greater head angles) without substantially any crease formation or loss of transverse curve smoothness. Conversely, a sailmaker can now add width to the spinnaker without adding excessive depth. As a result, the novel spinnaker will reach extremely well and is likewise a highly efficient running spinnaker. As it is well known, flatter, conventional spinnakers will reach better, but a flat head is needed for both a reaching and a running spinnakers. Put another way: Width in the upper sections is virtually unregulated, i.e. not affected by rating rule prescriptions. But, when a sail is widened, under the rules certain chord design limits must be maintained.

Returning now to FIG. 4, a leach 18 or a luff 23 on a symmetrical spinnaker 10 is shorter than the midline of 12 of the spinnaker 10. Consequently, in order to give fullness to the spinnaker and increase the midline 12 length, a wedge 30 as shown in FIG. 4 is cut out on a folded-over panel e.g., panel #1 to #6 (bottom panel #1 is also cut to satisfy the racing rules and to make a smooth curve between clew 13, midline 12 and tack 14).

Taking out the wedge 30 to form a panel works very satisfactorily until one gets to the vertical position within the spinnaker at which the leach 18 and luff 13 begin to coverage to form a head angle defined by the luff 18 and leach 23 at the head 11.

Figure 3:
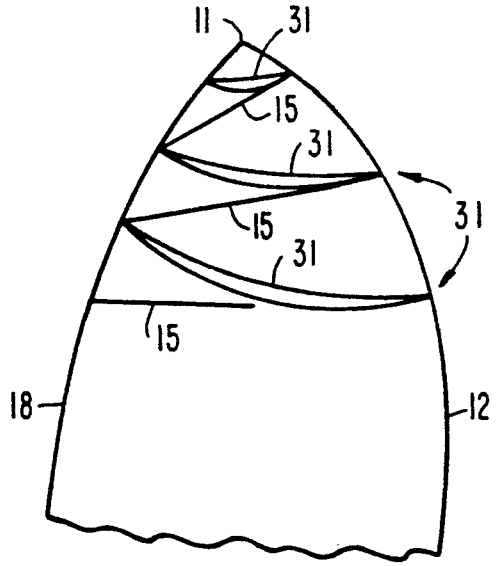
FIG. 3 is a partial side view of a half folded spinnaker with a schematic illustration of the novel panels in the head portion of the spinnaker.

As one tries to create a "spherical cone" such as shown in FIG. 3 in the upper panels #'s 8, 9, and 10, i.e. upper section of the spinnaker e.g., as shown in FIG. 1, taking out of the wedge 30 and fairing the chord does not distribute the vertical camber i.e. the depth between line 28 in FIG. 1 and midline 12 for the upper panels because the seams 15 are not everywhere along their length in these panels equidistant from the head 11. As a result control of leech (shoulder) tension and added regulation of depth can now be jointly achieved.

Figure 5:
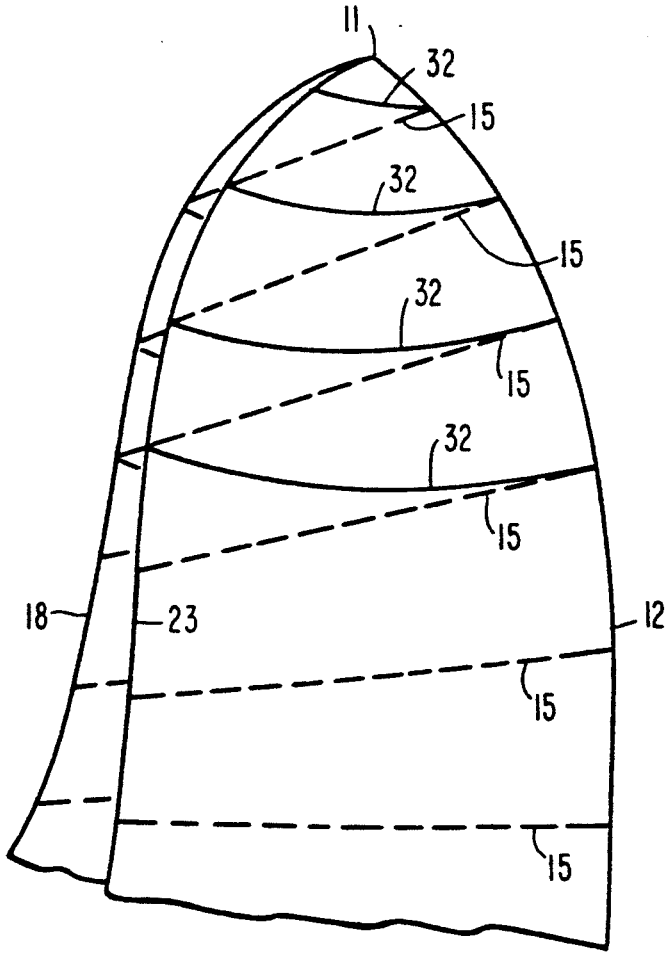
FIG. 5 is a schematic illustration of the cross-cut panel in a folded, partially perspective view of the spinnaker in the head section thereof.

As a result of the present discovery and invention, a new construction has been provided by introducing in the upper part of the spinnaker starting with the leach 18 and luff 23 to midline 12 a new panel construction in effect inserting a moon shaped panel 31 along the lines of the curve 32 shown e.g. in the panel #'s 7, 8, 9, and 10 in FIG. 2 and as further shown in FIG. 5.

Figure 6:
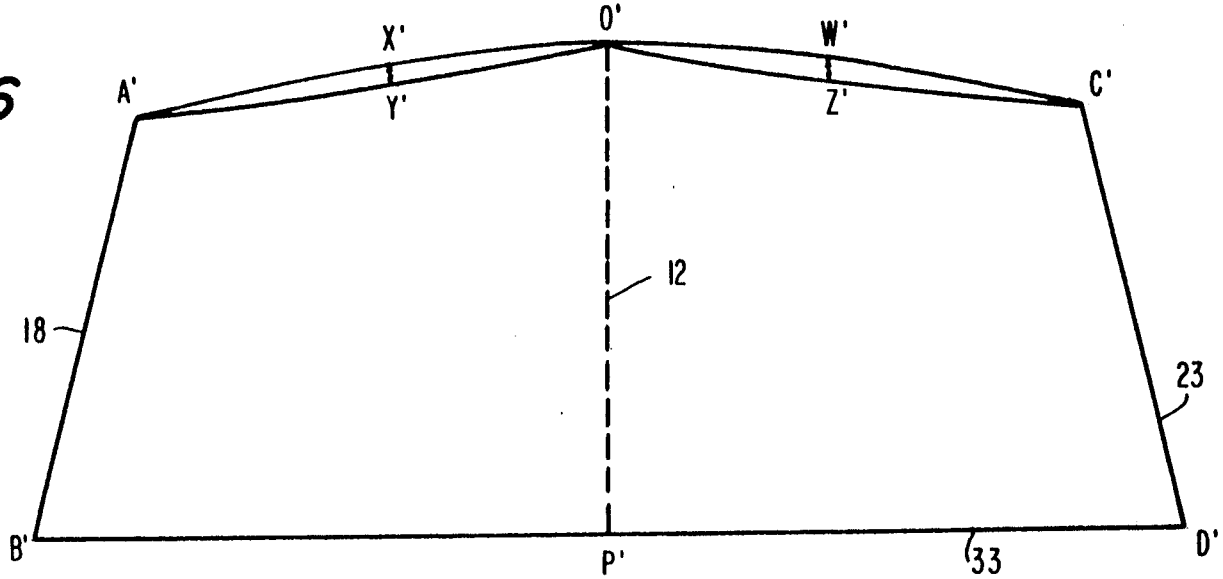
FIG. 6 is an illustration of a front view of a cross-cut panel in the center section thereof, showing where the top seam is meeting the next, modified novel panel in the head portion as shown in FIG. 7.

In reference to FIG. 6 it shows the last panel e.g. #6, in the center section of the spinnaker at the bottom of the panel along lines $B^1$, $P^1$, $S^1$ a straight line before the spinnaker leach 18 and luff 23 starts converging towards the head panels are expanded trapezoidal—the degree of trapezoidedness depends upon the vertical height to where the girth is carried.

Figure 7:
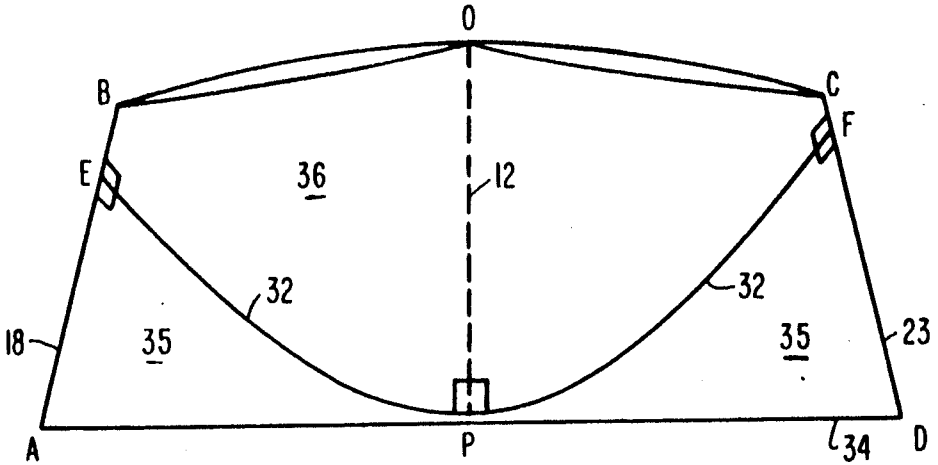
FIG. 7 illustrates in a schematic front view the panel layout for the novel spinnaker before the insertion of the subpanels shown in FIG. 8.

In FIG. 7, the new seam 32 has been shown with corresponding notation for the conventional cross-cut panel 33 and the cross-cut panel 34 now modified to consist of four component parts, a saddle shaped sub-panel 35, a bowl shaped sub-panel 36 and two moon shaped sub-panels 31 previously identified in FIG. 3, and also shown in FIGS. 8 and 9. Thus, the moon shaped panels 31 are inserted in panel #7 in FIG. 7 as defined by the curve E, P, F which is shown by the corresponding points E, P, F in FIGS. 8 and 9. As the panels shown in FIG. 6, 7, 8 and 9 are symmetrical, these may be constructed of mirror image sub panels about the center seam 12, including the moon shaped sub panels 31. These parts are then assembled into a whole panel as shown in FIG. 9. For ease of construction, the upper part of each panel defined by the lines $A^1$, $O^1$, and $C^1$ (or B, O, and C) which joins a novel panel such as shown in FIG. 9, and may be of straight lines, although these seams (which form seams 15 in FIG. 1) may also be curved slightly to introduce the finishing touches or curvatures which provide for the outstanding smoothness, depth control, desired head angle and shoulder size, etc. as desired by the particular sailmaker. These curves may now be drawn by CAD programs readily available for such purpose and thereafter cut by CAM program driven cutters such as laser cutters. Also, rather than inserting a symmetrical moon-shaped inserts, A CAD-CAM set-up can simply enlarge $B^2O^2C^2$-$P^2E^2$ properly and cut it independently of $E^2P^2F^2D^2P^2A^2$ as shown in FIG. 9*a*. As seen from FIG. 9*a*, the CAD-CAM system may integrate the moon-shaped panel 31 into the panel $B^2O^2C^2F^2P^2E^2$. The area represented by the moon-shaped panel replacement 31*a* is shown exterior to the dashed lines in FIG. 9*a*.

Additionally, radiused cuts 31*b* shown in FIG. 9*b* and panels corresponding to these can be created by a CAD-CAM system so that the new seams formed by the cuts 31*b* extend into the next lower panel.

With respect to asymmetrical spinnakers 50 as shown in FIG. 10, this figure illustrates a spinnaker for a one design sail boat known as International 14. For spinnaker 50 an appropriate imaginary line 51 for maximum depth is constructed between a leach 52 and a luff 53. About this line the novel upper panels are constructed in a similar manner as shown in FIGS. 6 to 9*b*. These panels, by definition will have a left hand and right hand dissimilarity about the imaginary line 51 as the luff 53 and leach 52 are of unequal length. Thus the moon shaped sub panels 31 of FIG. 8 will be asymmetrical and of different size for the left hand and right hand side of the asymmetrical spinnaker.

For the panels as shown in FIGS. 6 to 10, the thread placement as disclosed in my U.S. Pat. No. 4,708,080 and U.S. Pat. No. 5,038,700 may be practiced in the various combinations shown in these patents and such as in FIGS. 1 and 10. Such thread reinforced panels and their thread placement may be appropriately designed such as by computer assisted design (CAD) programs so that each thread, i.e. as a structural element in the panel properly join the threads in the next panel and form the proper catenary in the sail. Each of the seams in the formation of the panel shown in FIG. 9 may then be glued. Of course, if the spinnaker is made of the novel panels constructed of woven material such as nylon or lightweight polyester, or even Spectra yarns (a bulk polymerized high performance polyethylene polymer sold by Allied Chemical Corp. of Morristown, N.J.) then conventional sewing may also be employed.

For the corner panels in the area about tack 14 and clew 13 the structural elements 27 may be added in the manner disclosed in my U.S. Pat. No. 4,593,639 and the first two, three or four panels may be made as a sub-assembly with the structural elements running across seams 15. The same is also true as it concerns the placement of structural elements 27 in the head portion thereof.

Similarly, when panels such as shown in FIG. 9 to 9*a* are made of materials such as film and threads, then appropriate lamination and reinforcement schedules may be appropriately developed especially for high load areas such as reinforcement panels shown by the illustration of panel 11*a* in FIG. 1.

Although a cross-cut panel constructed spinnaker is preferred, the present head section design allows the clew and tack construction of various types such as of the tri-radial type (as it is well known in the art). Such equivalent clew and tack layouts are within the purview of the invention as are other equivalents which fall within the scope of the invention as further defined by the scope of the claims herein.

What is claimed is:

1. As an article of manufacture a spinnaker sail comprised of a head, tack and clew and of a cross-cut construction, the improved article comprised of a series of panels including a plurality of panels in a head section of said spinnaker at which a luff and a leach converge into said head for said spinnaker, each of said plurality of panels in said head section comprising a bowl-shaped sub-panel, a saddle shaped sub-panel and therebetween for each side of said saddle shaped sub-panel a pair of crescent, moon-shaped panels integral with said bowl and saddle shaped sub-panels.

2. The article of manufacture as defined in claim 1, wherein said plurality of panels in said head portion include a plurality of radiating structural members integral therewith.

3. The article of manufacture as defined in claim 1, wherein said spinnaker sail is a symmetrical sail.

4. The article of manufacture as defined in claim 1, wherein said spinnaker sail is an asymmetrical sail.

5. The article of manufacture as defined in claim 1, wherein said cross-cut construction is of panels of spunbonded polyalkylene polymer sheets.

6. The article of manufacture as defined in claim 1, wherein said cross-cut construction is of panels of nylon laminated with a polyester, polyvinylidene fluoride, or a polyurethane film.

7. The article of manufacture as defined in claim 5, wherein the spunbonded sheet includes a film on one side thereof.

8. The article of manufacture as defined in claim 1, wherein each point load location comprised of a tack panel, a clew panel and a head panel includes structural members integral therewith, said structural members projecting radiatingly outwardly into a number panels for said spinnaker sail.

9. The article of manufacture as defined in claim 1, wherein said panels are of spunbonded sheet panels and, as an insert between said sheet and a film, a plurality of load carrying fibers oriented along principal stress lines in said spinnaker sail.

10. The article of manufacture as defined in claim 9, wherein said fibers define a catenary within said spinnaker sail.

11. The article of manufacture as defined in claim 9, wherein said spunbonded sheet is of polypropylene fibers.

12. The article of manufacture as defined in claim 9, wherein said spunbonded sheet is of polyester fibers.

13. The article of manufacture as defined in claim 9, wherein said spunbonded sheet is of polyethylene fibers.

14. The article of manufacture as defined in claim 9, wherein the film is a polyester, polyurethane or polyvinylidene fluoride film of a thickness of more than 0.2 and less than 1 mil.

15. The article of manufacture as defined in claim 9, wherein said fibers are of polyester, aramid, polyamide or polyalkylene polymers.

16. The article of manufacture as defined in claim 8, wherein said structural members are of polyamide polymers.

17. The article of manufacture as defined in claim 1, wherein each panel of a sail is comprised of at least two mirror image sub-panels symmetrical about a midline for said spinnaker sail.

18. The article of manufacture as defined in claim 1, wherein said panels are of a woven nylon material.

19. The article of manufacture as defined in claim 18, wherein said woven nylon material is laminated to a polyester and/or a polyvinyledene fluoride film of a thickness between 0.2 mil and 1 mil.

20. The article of manufacture as defined in claim 1, wherein the panels are of woven polyester material.

21. As an article of manufacture a spinnaker sail comprised of a head tack and clew and of a cross-cut construction, the improved article comprised of a series of panels, including a plurality of panels in a head section of said spinnaker at which a luff and leach coverage in said head section comprising: a bow-shaped sub-panel with hemispherical sides and, a saddle shaped sub-panel wherein said bowl-shaped sub-panel with hemispherical sides includes an area defined as a crescent, moon-shaped extension of said bowl at each of said hemispherical sides as an integral part of said bowl-shaped sub-panel.

22. The article of manufacture as defined in claim 21, wherein said bowl-shaped sub-panel includes sub-sub panels on each side of a centerline for said bowl-shaped sub-panel.

23. The article of manufacture as defined in claim 21, wherein said bowl-shaped sub-panel is asymmetrical.

24. The article of manufacture as defined in claim 21, wherein said bowl-shaped sub-panel includes an extension into an adjacent cross-cut panel for said spinnaker.

25. The article of manufacture as defined in claim 24, wherein said extension is a sub-sub panel of said bowl-shaped sub-panel.

26. The article of manufacture as defined in claim 21, wherein said saddle-shaped sub-panel comprises of at least two sub-sub panels.

27. The article of manufacture as defined in claim 26, wherein each of the saddle-shaped panel sub-sub panel is about triangular in shape.

28. The article of manufacture as defined in claim 27, wherein said sub-sub panel is triangular and asymmetrical to each other.

29. The article of manufacture as defined in claim 27, wherein each sub-sub panel is triangular and is separated from each other by a bowl-shaped sub-panel for a cross-cut panel.

30. The article of manufacture as defined in claim 29, and wherein said saddle-shaped sub-panel is in shape of a triangular sub-sub panel and wherein a bottom of said triangular sub-sub panel forms a seam for an adjacent cross-cut panel for said spinnaker said.

* * * * *